US005110632A

United States Patent [19]

Kawaguchi et al.

[11] Patent Number: 5,110,632

[45] Date of Patent: May 5, 1992

[54] RECIPROCATING PAINTING METHOD

[75] Inventors: Shin Kawaguchi; Yutaka Ohhashi; Kenji Fukuta, all of Aichi, Japan

[73] Assignee: Toyota Jidosha Kabushiki Kaisha, Japan

[21] Appl. No.: 725,524

[22] Filed: Jul. 3, 1991

[30] Foreign Application Priority Data

Aug. 15, 1990 [JP] Japan ..... 2-215290

[51] Int. Cl.[5] ..... B05D 1/02

[52] U.S. Cl. ..... 427/424; 118/313; 118/315; 118/323

[58] Field of Search ..... 427/421, 424; 118/315, 118/313, 323

[56] References Cited

U.S. PATENT DOCUMENTS

| | | | |
|---|---|---|---|
| 2,588,125 | 3/1952 | Knowland | 427/424 |
| 3,027,273 | 3/1962 | Sacks | 427/424 X |
| 3,274,860 | 9/1966 | Gauthier | 118/323 X |
| 3,885,066 | 5/1975 | Schwenninger | 427/424 X |
| 4,762,013 | 8/1988 | Peter et al. | 118/323 X |
| 4,909,180 | 3/1990 | Oishi | 118/323 X |

FOREIGN PATENT DOCUMENTS

| | | |
|---|---|---|
| 57-165064 | 10/1982 | Japan . |
| 60-255170 | 12/1985 | Japan . |
| 61-234970 | 10/1986 | Japan . |
| 62-13557 | 1/1987 | Japan . |
| 1-315361 | 12/1989 | Japan . |

OTHER PUBLICATIONS

English Equivalent Abstracts for Japanese patent publications 57-165064, 60-255170, 61-234970, 1-315361.

*Primary Examiner*—Shrive Beck
*Assistant Examiner*—Alain Bashore
*Attorney, Agent, or Firm*—Finnegan, Henderson, Farabow, Garrett & Dunner

[57] ABSTRACT

There is disclosed a method of painting an object by reciprocating a plurality of painting machines perpendicularly to the direction in which the object is conveyed on a production line. The delivery of paint from the painting machines is cut off at each turn of the orbits drawn by the adjacent ones of the reciprocating painting machines which create overlapping orbits. The starting points and the ending points of the cutoff for the adjacent machines are placed on the same straight line on the object.

3 Claims, 4 Drawing Sheets

RECIPROCATING PAINTING METHOD

BACKGROUND OF THE INVENTION

1. Field of the Invention

The present invention relates to a method of painting an object by reciprocating painting machines perpendicularly to the direction in which the object is conveyed and, more particularly, to a method of painting an object by reciprocating a plurality of painting machines arranged perpendicular to the direction in which the object is conveyed.

2. Description of the Prior Art

Numerous painting methods are known in which painting machines are reciprocated relative to a painted object that is conveyed at a predetermined constant speed. These known methods are disclosed, for example, in Japanese Patent Laid-Open Nos. 165064/1982, 255170/1985, 234970/1986, and 315361/1989.

Where an object having a large portion to be painted such as an automotive body is painted by reciprocating painting method, if one painting machine is used to cover the whole area of the painted portion of the object, then the speed at which the object is conveyed must be slowed down. This greatly deteriorates the productivity. Accordingly, the conventional method for painting an object having such a large painted portion has consisted in arranging plural, or two to four, painting machines perpendicularly to the direction in which the object is conveyed and reciprocating these machines in the direction in which they are arranged, for painting the object.

One kind of mechanism for reciprocating a painting machine transforms rotary motion of a rotating disklike cam into a rectilinear motion via a link and transmits the motion to the painting machine. This mechanism is generally adopted as a reciprocator, because it is simple in structure. Therefore, the painting machine draws a sinusoidal trajectory on a virtual painted surface while the object is being conveyed. At each turn of the trajectory of the reciprocating painting, the moving speed of the painting machine slows down, so that the amount of paint applied per unit area increases. Therefore, it is inevitable that the thickness of the paint film is increased at each turn. Especially, where plural painting machines are reciprocated to paint the object as described above, the orbits P' and Q' drawn by a pair of adjacent reciprocating painting machines which constitute a unit painting system are made to slightly overlap with each other at each turn as shown in FIG. 6; otherwise lack of hiding would tend to occur. Conversely, if the orbits are made to overlap with each other sufficiently, then the thickness of the paint film around the boundary A between the two adjacent orbits is considerably larger than the thickness of the paint film around the intermediate points A and C of the orbits P' and Q' as shown in FIG. 7. This is a major cause of nonuniformity in the paint film thickness.

The above-cited Japanese Patent Laid-Open No. 234970/1986 discloses techniques for varying the amount of delivered paint according to the changes in the applied area and varying the width of the painting pattern according to the amount of the delivered paint. Increases in the thickness of the paint film can be suppressed to some extent by controlling both amount of delivered paint at each turn of the painting orbit and width of the painting pattern, utilizing these techniques. However, it is very difficult to appropriately set the painting conditions such as the amount of delivered paint and the shaping air pressure. Especially, where a rotary atomizing electrostatic painting machine which applies paint efficiently is used, nonuniformity in the paint film thickness or lack of hiding often takes place unless the set conditions are maintained strictly. In this way, this method is not reliable.

SUMMARY OF THE INVENTION

It is an object of the invention to provide a reciprocating painting method that certainly and easily prevents the thickness of the produced paint film from increasing around the boundaries between the orbits drawn by plural reciprocating painting machines at which the orbits overlap with each other, whereby greatly contributing to an improvement in the painting quality.

The above object is achieved in accordance with the teachings of the invention by a method of painting by reciprocating a plurality of painting machines in the direction in which the machines are arranged, the machines being arranged perpendicularly to the direction in which the object is conveyed, the method being characterized in that the delivery of paint is cut off at each turn of the orbits drawn by the adjacent ones of the reciprocating painting machines and that the starting points and the ending points of the cutoff for the adjacent machines are placed on the same straight line.

Preferably, the delivery of the paint is cut off when the moving speeds of the painting machines are reduced down greatly.

Although any kind of means or reciprocator can be used to reciprocate the painting machines, the use of a mechanism which causes the painting machines to draw sinusoidal curves yields especially desired results. In this case, it is possible to support plural painting machines by one reciprocator so that they may move as a unit. Also, it is possible to support plural painting machines by their respective reciprocators and to move them in synchronism.

Any arbitrary painting machines can be employed in the present invention. For example, rotary atomizing painting machines or air atomizing painting machines can be utilized.

In the reciprocating painting method described above, the delivery of the paint is cut off at each turn of the orbits drawn by the reciprocating painting machines. This prevents the thickness of the produced paint film from increasing in the vicinities of the boundaries at which the orbits of the plural machines overlap with each other. In addition, the starting points and the ending points of the cutoff for the adjacent machines are located on the same straight line. Hence, lack of hiding which would otherwise be caused by separation of the adjacent painting patterns can be prevented.

Other objects and features of the invention will appear in the course of the description thereof which follows.

PREFERRED EMBODIMENT OF THE INVENTION

Figure 3:
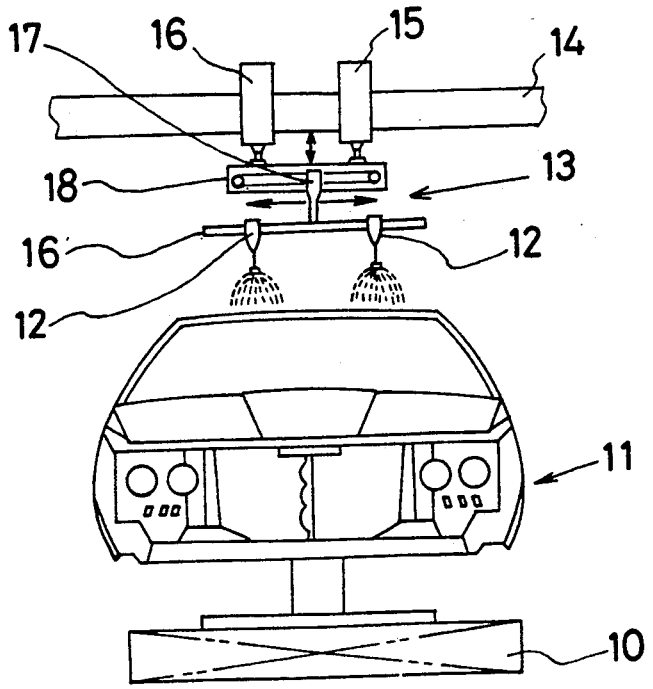
FIG. 3 is a front elevation of a painting system carrying out the reciprocating painting method according to the invention.

In one embodiment of the invention, a metallic paint is applied to the upper surface of an automotive body by means of reciprocating painting machines. Only one pair of them which constitute a unit painting system are shown in FIG. 3, where the automotive body 11 is conveyed by a conveyor 10. Two rotary atomizing electrostatic painting machines 12 are spaced a given distance from each other perpendicularly to the direction in which the body 11 is conveyed. The machines 12 are mounted above the body 11 and supported by a reciprocator 13 such that the machines 12 can be reciprocated at right angles to the direction in which the automotive body 11 is conveyed. The reciprocator 13 is held to a cylinder 15 mounted to a frame 14 so that the machines 12 can be moved vertically via the reciprocator 13.

Figure 4:
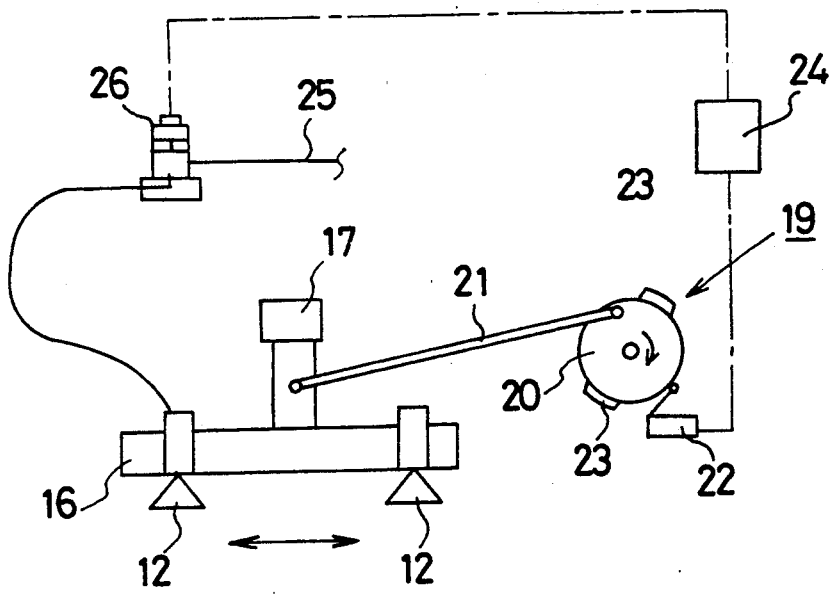
FIG. 4 is a schematic block diagram of main portions of the painting system shown in FIG. 3.

Referring also to FIG. 4, the reciprocator 13 comprises a support arm 16 to which the painting machines 12 are mounted, a sliding member 17 extending upward from the arm 16, a guide member 18 for causing the slide member 17 to slide horizontally, and a rotary cam mechanism 19 for driving the sliding member 17. The cam mechanism 19 includes a disklike cam 20 driven by an electric motor (not shown). One end of a link 21 is pivotally mounted to the sliding member 17, while the other end is pivoted eccentrically to the cam 20. When the cam 20 rotates, the rotary motion is transmitted via the link 21 to the sliding member 17, which is moved along the guide member 18. The support arm 16 and the painting machines 12 integral with the arm 16 are reciprocated perpendicularly to the direction of the conveyance of the automotive body 11 with a stroke twice as large as the distance between the center of the eccentrically pivoted end of the link 21 and the axis of rotation of the cam 20.

A limit switch 22 is disposed around the cam 20. When the switch 22 engages a pair of dogs 23 mounted on the outer periphery of the cam 20, the switch 22 is closed. The dogs 23 are located at positions corresponding to the turns of the orbits drawn by the reciprocating painting machines 12. In this example, the dogs 23 cover angular ranges from 70° to 110° and from 250° to 290° of the plate cam 20. The switch 22 is electrically connected with a controller 24. A circuit 25 for controlling the supply of paint to the painting machines 12 has a valve 26 which is also electrically connected with the controller 24. When each painting machine 12 arrives at a turn of the painting orbits, the limit switch 22 engages one of the dogs 23. The switch 22 then produces an output signal. The controller 24 produces a signal for closing the valve 26 in response to the output signal from the switch 22. In this way, the delivery of the paint from the machine 12 is cut off.

Figure 5:
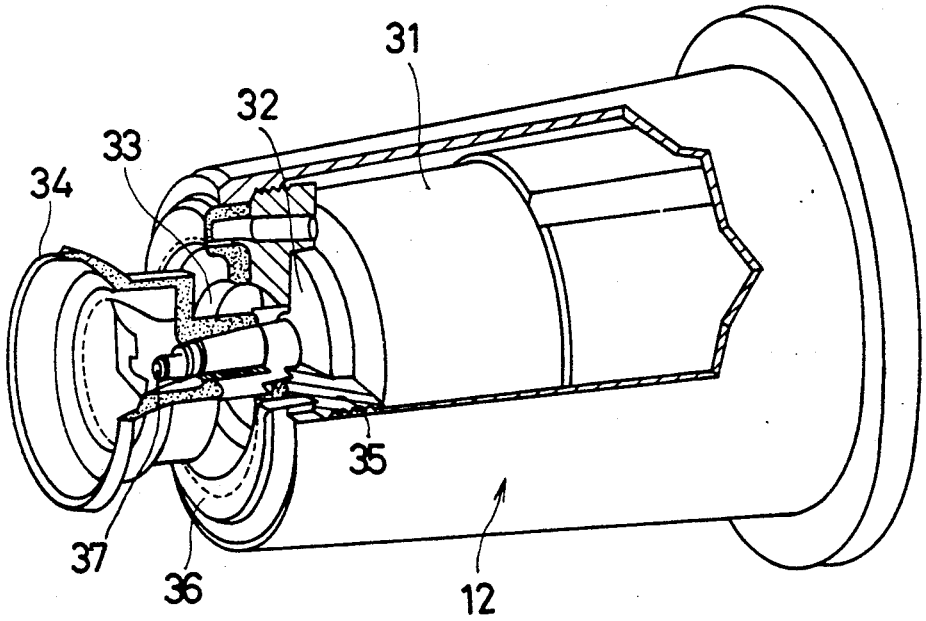
FIG. 5 is a partially cutaway perspective view of a painting machine used in the reciprocating painting method according to the invention.
Figure 6:
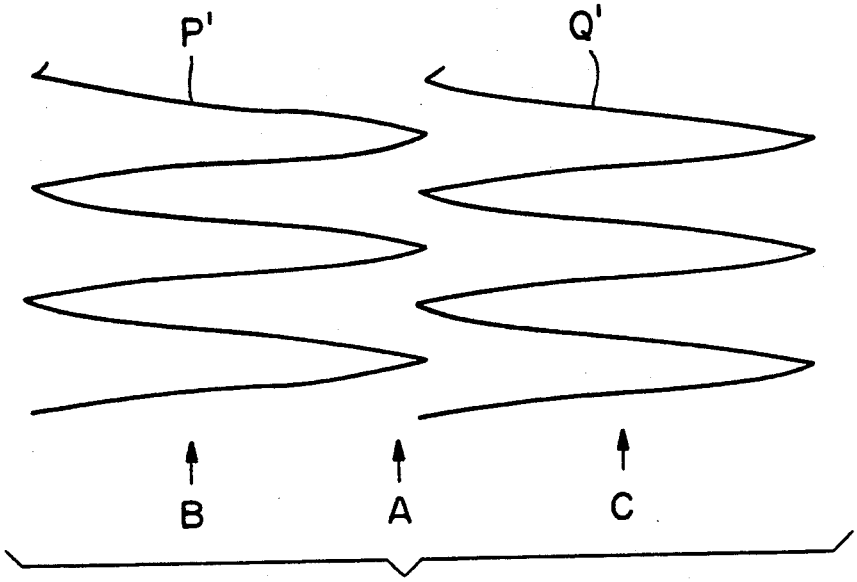
FIG. 6 PRIOR ART
FIG. 6 is a diagram showing the orbits drawn by a pair of reciprocating painting machines forming a unit painting system, the machines carrying out the prior art reciprocating painting method.
Figure 7:
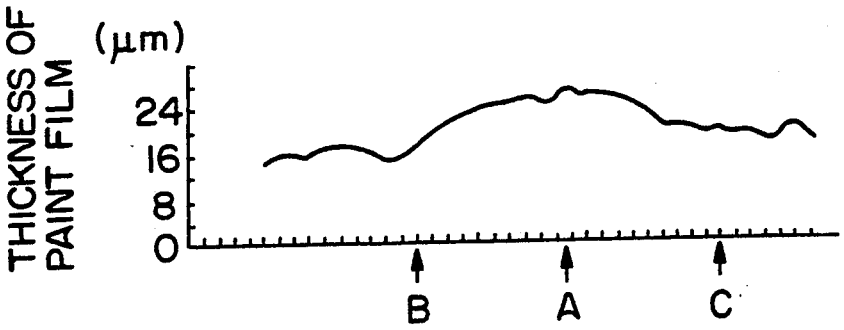
FIG. 7 PRIOR ART
FIG. 7 is a graph showing the distribution of the thickness of the paint film formed by the prior art reciprocating painting method.

Each painting machine 12 consisting of a rotary atomizing electrostatic painting machine is shown in FIG. 5, where the body of the machine 12 is indicated by numeral 31. A rotating shaft 33 is held inside the body 31 via an air bearing 32 and extends outwardly from the body 31. An atomizing head 34 is firmly mounted at the front end of the shaft 33 which is located outside the body 31. A head member 35 is mounted at the front end of the body 31 and provided with a multiplicity of exit holes 36 for ejecting shaping air toward the fringe of the atomizing head 34. A paint supply tube 37 is mounted along the axis of the body in such a way that it is not in contact with the shaft 33.

In the operation of this painting machine 12, the atomizing head 34 is rotated at a high speed by a driving means (not shown). At the same time, a high voltage is applied to the atomizing head 34 while supplying paint through the paint supply tube 37. The paint flows out to the front surface of the head 34 from a hole **34*a* formed in the head 34, runs across the front surface, and shifts to the outer periphery. Then, the paint is atomized by the centrifugal force. Concurrently, the atomized paint is electrically charged and travels toward the automotive body 11. In this way, the paint is applied to the body 11. In the present example, optimum conditions are established so that the pressure of the shaping air ejected from the exit holes 36** is increased to apply metallic paint.

Before the automotive body is painted, the reciprocator 13 is operated to reciprocate the painting machines 12. When the automotive body 11 is brought under the machines by the conveyor 10, paint is supplied to the painting machines 12. The paint is blown against the automotive body 11 that is being conveyed at a given speed. At this time, the cylinder 16 is operated to move the reciprocator 13 up and down, in order that the spacing between each painting machine 12 and the upper surface of the body 11 be maintained constant.

Figure 1:
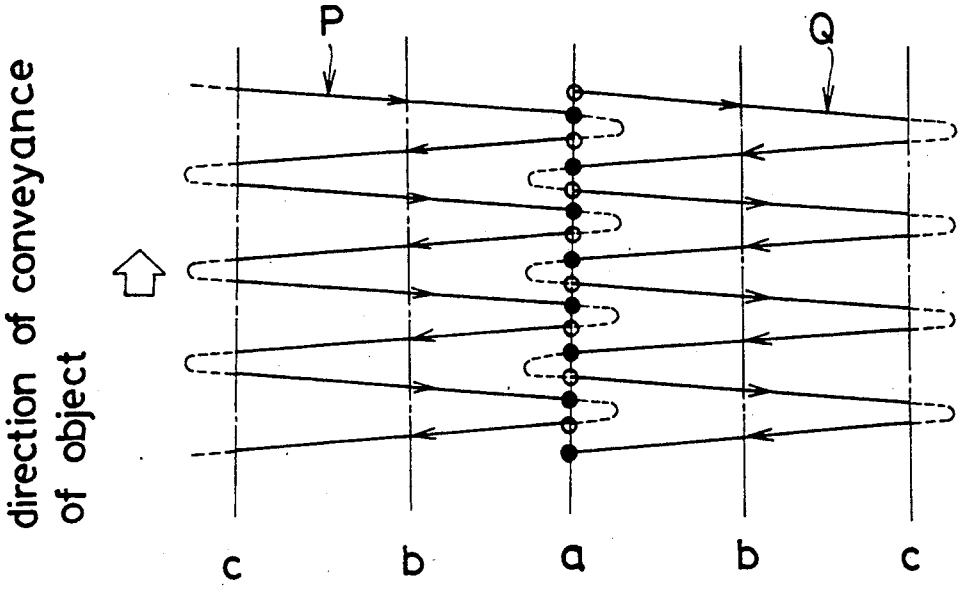
FIG. 1 is a diagram showing the orbits drawn by a pair of reciprocating painting machines forming a unit painting system, the machines performing painting operation in accordance with the invention.

Since the painting machines 12 make reciprocating movement, the centers of the atomizing heads 34 of the two machines 12 draw sinusoidal curves P and Q, respectively, as shown in FIG. 1. Whenever the rotating cam 20 of the reciprocator 13 rotates through a given angle, the limit switch 22 engages any one of the dogs 23 mounted on the outer periphery of the cam. In response to this engagement, the controller 24 produces a signal for closing the valve 26, thus cutting off the delivery of the paint from the painting machines 12. This cutoff is effected around each turn of the orbits drawn by the painting machines 12 because of the given disposition of the dogs 23 and continued while the limit switch 22 engages with either dog 23. In FIG. 1, the broken lines of the orbits indicate the ranges of the cutoff. In the present example, the spacing between both painting machines 12 is so set that the starting points (indicated by the black circles in FIG. 1) and the ending points (indicated by the white circles in FIG. 1) of the cutoff for both machines lie on the same straight line.

Figure 2:
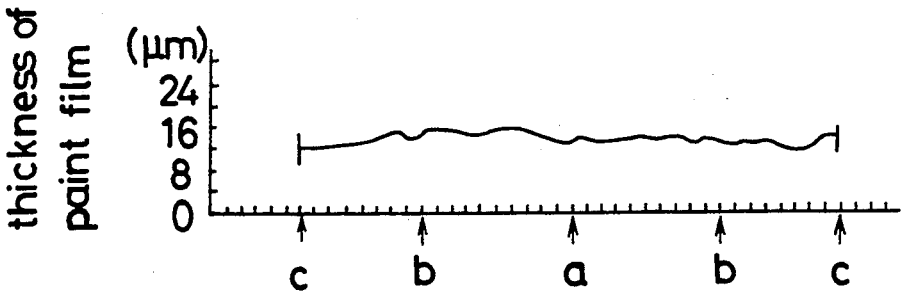
FIG. 2 is a graph showing the distribution of the thickness of the paint film formed by the reciprocating painting method according to the invention.

In this way, the delivery of the paint is cut off at each turn of the orbits drawn by the two reciprocating painting machines 12. The starting points and the ending points of the cutoff for both machines are placed on the same straight line. As a result, the thickness a of the produced paint film around the boundary between the orbits drawn by the two painting machines is substantially equal to the thickness b around the intermediate points P and Q of the orbits and also to the thickness c around turns which are located on the opposite sides of the above-described boundary as shown in FIG. 2. It can be seen therefore that nonuniformity in the paint film thickness can be prevented if painting is carried out, using the plural rotary atomizing electrostatic painting machines 12 which apply paint at high efficiency. In the present example, the ranges of the cutoff are set from 70° to 110° and from 250° to 290° of the angular positions of the cam 22 at which the cam 22 moves at low speeds. Consequently, the painting machines 12 move at a substantially constant speed within the region of the painted portion. Hence, the aforementioned nonuniformity in the paint film thickness can be prevented with greater certainty.

As described in detail thus far, in the novel reciprocating painting method, the paint film thickness is easily and certainly prevented from increasing around the boundary or boundaries between the orbits drawn by plural reciprocating painting machines. The reliability of the painting operation can be enhanced. Furthermore, the painting can find wider application.

What is claimed is:

1. A method of painting an object in conveying a plurality of painting machines arranged perpendicularly to the direction in which the object is conveyed and to be reciprocated in the direction of the arrangement of the machines, turning points of the orbits of the adjacent painting machines drawn above the object of which are overlapped in the conveying direction, comprising the step of:

cutting off the delivery of the paint at the area of overlapping of the orbits in such a way that the starting points and the ending points of the cutoff for the adjacent painting machines are located on one straight line along the conveying direction.

2. A method of painting an object as set forth in claim 1, wherein said plural painting machines are mounted on a reciprocator that is connected with a lever eccentrically supported on a disklike cam, and wherein the reciprocator is reciprocated by the rotation of the cam.

3. A method of painting an object as set forth in claim 1, wherein the start and the end of said cutoff are controlled by a limit switch that is activated by dogs mounted on the outer periphery of said cam.

* * * * *